US005372060A

United States Patent [19]

Maruyama et al.

[11] Patent Number: 5,372,060

[45] Date of Patent: Dec. 13, 1994

[54] HYDRAULIC VALVE ASSEMBLY

[75] Inventors: Jun Maruyama; Koji Yamashita; Naoki Ishizaki, all of Kanagawa, Japan

[73] Assignee: Kabushiki Kaisha Komatsu Seisakusho, Japan

[21] Appl. No.: 44,205

[22] Filed: Apr. 8, 1993

[30] Foreign Application Priority Data

Dec. 22, 1992 [JP] Japan ..... 4-341813

[51] Int. Cl.[5] ..... F15B 13/043

[52] U.S. Cl. ..... 91/436; 91/446; 91/454; 91/461; 137/596.15; 137/596.16

[58] Field of Search ..... 91/436, 446, 454, 461; 137/596.15, 596.16

[56] References Cited

U.S. PATENT DOCUMENTS 4,480,527 11/1984 Lonnemo ..... 91/454 X
4,646,622 3/1987 Ishizaki et al. ..... 91/454 X
5,136,930 11/1992 Karakama et al. ..... 137/596.15 X

FOREIGN PATENT DOCUMENTS 63-318302 12/1988 Japan .
63-318371 12/1988 Japan .
63-318374 12/1988 Japan .
64-6503 1/1989 Japan .
1-166181 11/1989 Japan .
1-275969 11/1989 Japan .
2-29359 2/1990 Japan .
2-51602 2/1990 Japan .

*Primary Examiner*—Gerald A. Michalsky
*Attorney, Agent, or Firm*—Ronald P. Kananen

[57] ABSTRACT

A hydraulic valve assembly comprises a valve body defining first and second valve receptacle bores, a fluid pump, a first fluid passage communicated with the fluid pump, a second fluid passage communicated with a hydraulic load, and a third fluid passage communicated with a fluid reservoir. A first valve sub-assembly including a sleeve enclosing a first valve mechanism therein is disposed within the first valve receptacle body for selectively permitting and blocking introduction of the pressurized working fluid. Also, a second valve sub-assembly including a sleeve enclosing a second valve mechanism therein is disposed within the second valve receptacle bore for selectively establishing and blocking fluid communication between the second and third fluid passage means. A third valve assembly is provided in the valve body for selectively establishing and blocking fluid communication between the load side of the first valve sub-assembly and the second fluid passage for supplying the pressurized working fluid to the hydraulic load. A control valve assembly is provided in the valve body for generating a control pressure for controlling position of the first and second valve subassemblies.

1 Claim, 2 Drawing Sheets

HYDRAULIC VALVE ASSEMBLY

BACKGROUND OF THE INVENTION

1. Field of the Invention

The present invention relates to a hydraulic valve assembly for supplying a pressurized working fluid from a hydraulic pump to an actuator, such as a hydraulic cylinder, a hydraulic motor and the like.

2. Description of the Related Art

FIG. 1 shows a typical construction of the conventional hydraulic valve assembly. The conventional hydraulic valve assembly has a valve body 1, in which a spool bore 2 is defined. The spool bore 2 is communicated with first and second inlet ports 3 and 4, first and second actuator ports 5 and 6, first and second tank ports 7 and 8. A valve spool 9 is slidably disposed within the spool bore 2 for selectively establishing and blocking fluid communication through respective ports. The valve body 1 is further formed with a pump port 10 which is selectively communicated with and blocked from the first and second inlet ports 3 and 4 by a load sensing valve 11. A first suction safety valve 12 is disposed between the first actuator port 5 and the first tank port 8. Also, a second suction safety valve 13 is provided between the second actuator port 6 and the second tank port 8. It should be noted that the first and second actuator ports 5 and 6 are connected to an actuator 17, the first and second tank ports 7 and 8 are connected to a tank 18, and the pump port 10 is connected to a pump 19.

In the hydraulic valve assembly constructed as set forth above, the valve spool 9 is formed with circumferential grooves 14 and 15 and lands 16 for selectively establishing and blocking fluid communication between respective ports. With the illustrated construction, sealing dimensions between the first actuator port 5 and the first tank port 7 and between the second actuator port 6 and the second tank port 8 are small to possibly cause leakage of the fluid from the first and second actuator ports 5 and 6 to the first and second tank ports 7 and 8.

Namely, in the construction set forth above, seal between the first actuator port 5 and the first tank port 7 and the second actuator port 6 and the second tank port 8 is established by sealing engagement between the inner periphery of the spool bore 2 and the lands 16 of the valve spool 9. Due to restriction of the overall size of the valve body 1 and of the stroke of the valve spool, the axial dimensions L1 of the lands 16 between the first and second actuator ports 5 and 6 and the first and second tank ports 7 and 8 become too small to satisfactorily establish the seal.

Also, in the prior art, the spool bore 2 and a plurality ports must be formed in the valve body 1 with high precision, machining is very difficult and thus cost intensive.

Furthermore, when a plurality of hydraulic valves assemblies are coupled to form a stack-type hydraulic valve assembly, the valve bodies are stacked and secured by means of stack bolts. In such case, the tightening torque of the stack bolts may cause deformation of the valve body to block sliding motion of the valve spool. To avoid this, in the prior art, the finishing of the spool bores has to be performed after assembling the valve bodies. Therefore, once the spool bore is finished, additional hydraulic valve assembly cannot be coupled.

SUMMARY OF THE INVENTION

Therefore, it is a general object of the present invention to provide a hydraulic valve assembly which can solve the drawbacks set forth above.

Another and more specific object of the present invention to provide a hydraulic valve assembly which can certainly prevent leakage of a working fluid from a high pressure side to a low pressure side.

A further object of the invention is to provide a hydraulic valve assembly which permits addition of an additional valve for a stack-type valve assembly.

A still further object of the invention is to provide a hydraulic valve assembly which can be machined at low cost.

In order to accomplish the above-mentioned and other objects, according to one aspect of the invention, a hydraulic valve assembly comprises:

a valve body;

a tank passage, first and second pump passages and first and second actuator passages defined in the valve body;

first and second cartridge valves disposed in the valve body for establishing and blocking fluid communication between the inlet sides and the outlet sides of the first and second pump passages;

cone seat type third and fourth cartridge valves disposed in the valve body for establishing and blocking fluid communication between the first and second actuator passages and the tank passage; and first and second load check valves for selectively establishing and blocking fluid communication between the outlet sides of the first and second pump passages and the inlet sides of the first and second actuator passages.

In the preferred construction, the third and fourth cartridge valves are provided pressure relief function for maintaining pressures in the first and second actuator passages lower than or equal to a predetermined set pressure. Also, the first and second load check valves may be provided with first and second suction valves for selectively establishing and blocking communication between the tank passage and the outlet sides of the first and second pump passages.

According to another aspect of the invention, a hydraulic valve assembly comprises:

a valve body defining first and second valve receptacle bores;

a fluid pump;

a first fluid passage means communicated with the fluid pump for introducing a pressurized working fluid therefrom;

a second fluid passage means communicated with a hydraulic load;

a third fluid passage means communicated with a fluid reservoir for recirculating the working fluid thereto;

a first valve sub-assembly including a sleeve enclosing a first valve mechanism therein and disposed within the first valve receptacle body for selectively permitting and blocking introduction of the pressurized working fluid through the first fluid passage;

a second valve sub-assembly including a sleeve enclosing a second valve mechanism therein and disposed within the second valve receptacle bore for selectively establishing and blocking fluid communication between the second and third fluid passage means;

a third valve assembly for selectively establishing and blocking fluid communication between the load side of the first valve sub-assembly and the second fluid passage means for supplying the pressurized working fluid to the hydraulic load; and a control valve assembly for generating a control pressure for controlling position of the first and second valve sub-assemblies between a supply mode position where the pressurized fluid from the fluid pump is supplied to the hydraulic load through the first valve sub-assembly and the third valve assembly, and a drain mode position where feeding back of the working fluid from the hydraulic load through the second valve sub-assembly and the third fluid passage means.

In the construction set forth above, the second control valve sub-assembly preferably includes a cone seat type valve. In the preferred construction, the first valve sub-assembly may comprise the sleeve defining an inlet communicated with a supply side of the first fluid passage means and an outlet communicated with load side of the first fluid passage means and a valve spool thrustingly disposed within the sleeve for selectively establishing and blocking the inlet side and the outlet side. Also, the second valve sub-assembly may comprise the sleeve defining an inlet communicated the second fluid passage and an outlet communicated with the third fluid passage means, and a valve spool thrustingly disposed within the sleeve for selectively establishing and blocking fluid communication between the inlet and outlet thereof. In the further preferred construction, the second valve sub-assembly includes a pressure relieving means responsive to a pressure in the second fluid passage means in excess of a predetermined pressure for relieving excess pressure to the third fluid passage means therethrough. Practically, the pressure relieving means may be incorporated in the valve spool.

The first and second valve sub-assembly may define pressure chambers defined in the sleeve and introducing therein the control pressure, and the control valve means includes first control pressure supply means for supplying the control pressure to the first valve sub-assembly in the supply mode and a second control pressure supply means for supplying the control pressure to the second valve sub-assembly in the drain mode. In this case, each of the first and second control pressure supply means includes an electromagnetic actuator responsive to an electric control signal for adjusting magnitude of the control pressure. In the preferred construction, the electromagnetic actuator comprises a proportioning solenoid.

In the further preferred construction, the third valve assembly includes a suction valve responsive to a pressure in the first fluid passage to establish fluid communication between the first fluid passage and the third fluid passage for sucking the fluid in the third fluid passage when the pressure in the first fluid passage means drops below an atmospheric pressure.

According to a further aspect of the invention, a hydraulic valve assembly comprises:

a valve body defining first and second valve receptacle bores;

a fluid pump;

a first fluid passage means communicated with the fluid pump for introducing a pressurized working fluid therefrom;

a second fluid passage means communicated with a hydraulic load;

a third fluid passage means communicated with a fluid reservoir for recirculating the working fluid thereto;

a first valve assembly including a first valve mechanism therein and disposed within the first valve receptacle body for selectively permitting and blocking introduction of the pressurized working fluid through the first fluid passage;

a second valve assembly including a cone seat type second valve mechanism therein and disposed within the second valve receptacle bore for selectively establishing and blocking fluid communication between the second and third fluid passage means;

a third valve assembly for selectively establishing and blocking fluid communication between the load side of the first valve assembly and the second fluid passage means for supplying the pressurized working fluid to the hydraulic load; and a control valve assembly for generating a control pressure for controlling position of the first and second valve assemblies between a supply mode position where the pressurized fluid from the fluid pump is supplied to the hydraulic load through the first valve assembly and the third valve assembly, and a drain mode position where feeding back of the working fluid from the hydraulic load through the second valve assembly and the third fluid passage means.

Preferably, at least one of the first and second valve assembly comprises a sub-assembly fabricated independently of the valve body.

BRIEF DESCRIPTION OF THE DRAWINGS

The present invention will be understood more fully from the detailed description given herebelow and from the accompanying drawings of the preferred embodiment of the invention, which, however, should not be taken to be limitative to the invention, but are for explanation and understanding only.

In the drawings.

DESCRIPTION OF THE PREFERRED EMBODIMENT

Figure 1:
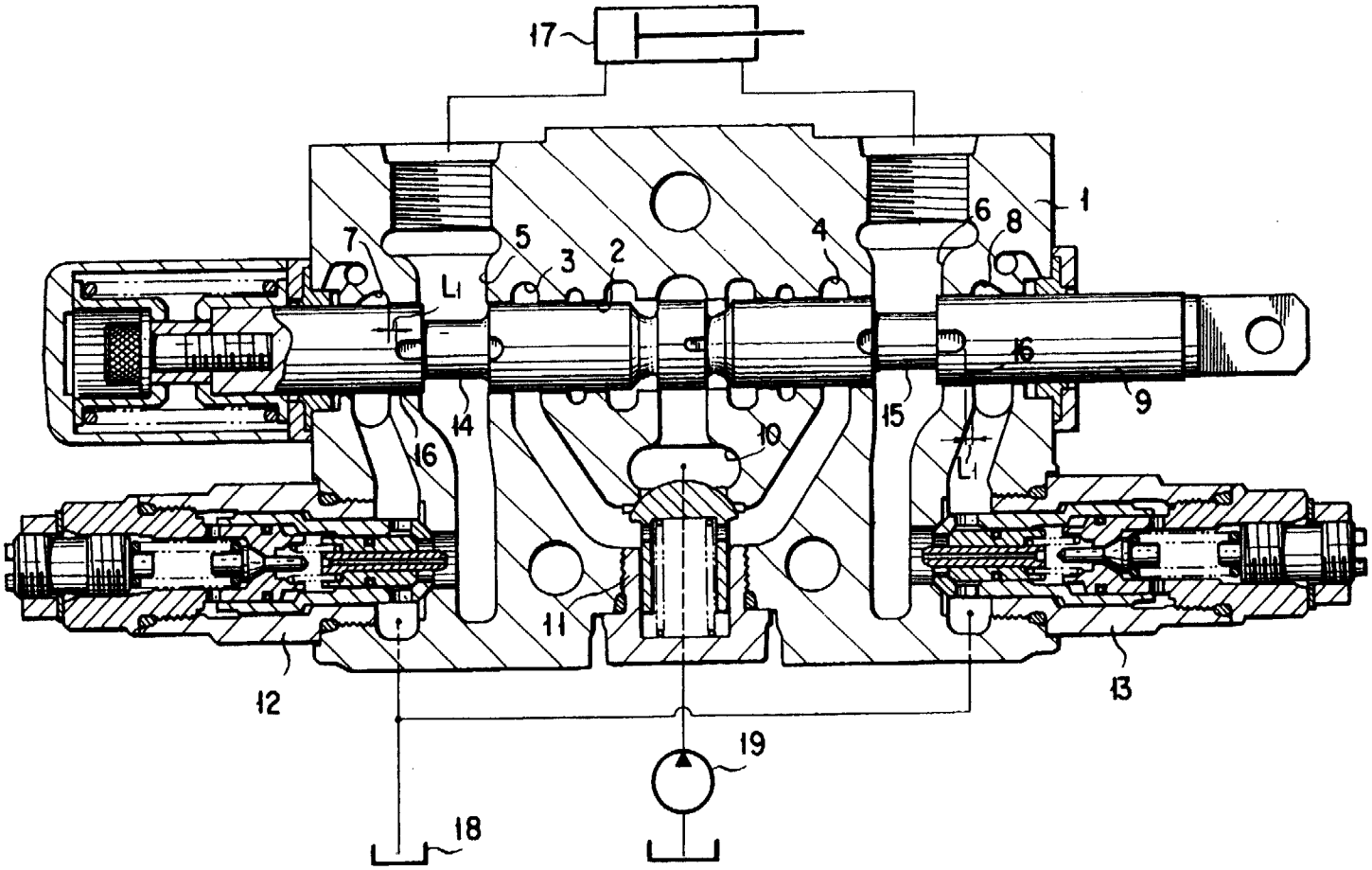
FIG. 1 PRIOR ART
FIG. 1 is a section of the conventional hydraulic valve assembly.
Figure 2:
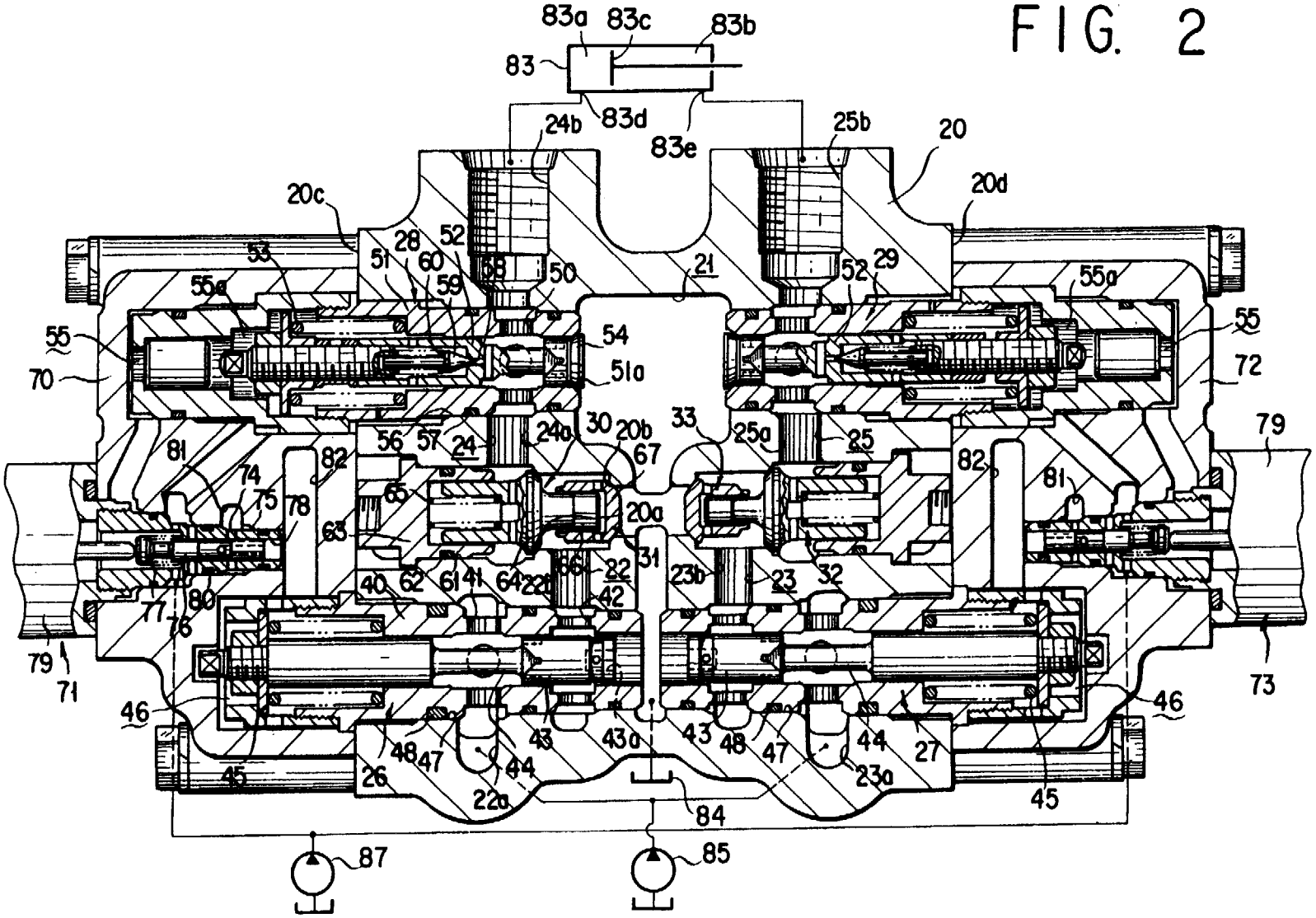
FIG. 2 is a section of the preferred embodiment of a hydraulic valve assembly according to the present invention.

Referring to FIG. 2, the preferred embodiment of a hydraulic valve assembly, according to the present invention, includes a valve body 20 which defines a tank passage 21 at the lateral center portion. First and second pump passages 22 and 23 and first and second actuator passages 24 and 25 are defined at both sides of the tank passage 21. First and second cartridge valve units 26 and 27 are disposed in the valve body 20 for establishing and blocking fluid communication between the inlet side **22*a* and the outlet side of the first pump passage 22 and between the inlet side 23*a* and the outlet side 23*b* of the second pump passage 23. Also, third and fourth cartridge valves 28 and 29 are disposed in the valve body 20 for establishing and blocking fluid communication between the intermediate portion between the inlet side 24*a* and the outlet side 24*b* of the first actuator passage 24 and the tank passage 21, and between the intermediate portion between the inlet side 25*a* and the outlet side 25*b* of the second actuator passage 25 and the tank passage 21**.

A first load check valve 30 is disposed in the valve body 20 for establishing and blocking fluid communication between the outlet side 22*b* of the first pump passage 22 and the inlet side 24*a* of the first actuator passage 24. Also, a first suction valve 31 is provided in the valve body 20 for establishing and blocking fluid communication between the outlet side 22*b* of the first pump passage and the tank passage 21.

In the similar manner, a second load check valve 32 is provided in the valve body 20 for establishing and blocking fluid communication between the outlet side 23*b* of the second pump passage 23 and the inlet side 25*a* of the actuator passage 25. A second suction valve 33 is also provided in the valve body 20 for establishing and blocking fluid communication between the outlet side 23*b* of the second pump passage 23 and the tank passage 21.

Each of the first and second cartridge valves 26 and 27 is provided with a sleeve 40. The sleeve 40 is formed with an inlet port 41 and an outlet port 42, and slidingly receives a spool 43. The spool 43 is formed with a circumferential groove 44 and lands for selectively establishing and blocking fluid communication between the inlet port 41 and the outlet port 42. A set spring 45 is disposed in the sleeve 40 in contact with the spool 43 for normally biasing the spool at a fluid communication blocking position. A pressure chamber 46 is defined in the sleeve 40 for exerting a hydraulic force to shift the spool 43 toward a fluid communication establishing position against the biasing force of the spring 46 by a pressurized fluid introduced therein. The sleeve 40 engages within a mounting bore 47. A sealing member 48, such as an O-ring, is disposed between the outer periphery of the sleeve 40 and the inner periphery of the mounting bore 47 for establishing a liquid tight seal therebetween. The inlet port 41 is communicated with the inlet side 22*a*, 23*a* of the first and second pump passage 22, 23, and the outlet port 42 is communicated with the outlet side 22*b*, 23*b* of the first and second pump passage 22, 23. The outlet port 42 is also communicated with the tank port 21 via a fluid communication passage 43*a* defined through the spool 43. The fluid communication passage 43*a* serves to relieve the pressure at the upstream side of the first and second load check valves 30 and 32.

Each of the third and fourth cartridge valves 28 and 29 is cone seal type cartridge valve which has a sleeve 51 defining a port 50. A spool 52 is disposed within the sleeve 51. The spool 52 is normally biased toward one direction by means of a spring 53 so that a cone seat 54 is normally seated on a sealing seat 51*a* of the sleeve 51. The sleeve 51 further defines a pressure chamber 55 for exerting a hydraulic force depending upon the fluid pressure introduced therein to cause shifting of the cone seat 54 of the spool 52 away from the sealing seat 51*a* of the sleeve 51. The sleeve 51 is disposed in a mounting bore 56 of the valve body 20. A sealing member 57, such as an O-ring, is disposed between the inner periphery of the mounting bore 56 and the outer periphery of the sleeve 51 so as to establish a liquid tight seal. The port 50 is in communication with the first and second actuator passage 24 and 25. Also, the axial bore of the sleeve 51 for slidingly receiving the spool 52 is opened to the tank passage 21. With this construction, the cone seat 54 is moved toward and away from the sealing seat 51*a* for selectively establishing and blocking fluid communication between the first and second actuator passages 24 and 25 and the tank passage 21.

The spool 52 is formed with a communication passage 58 for communicating the port 50 and the pressure chamber 55. The communication passage 58 is normally closed by a biased poppet 59. The poppet 59 is normally biased toward the poppet 59. The poppet 59 is normally biased toward the communication passage 58 for closing the latter. The poppet 59 is responsive to the pressure at the port 50 reaching and/or exceeding a set pressure corresponding to the set force of a spring 60, to shift away from the communication passage 58 so as to permit the pressurized fluid at the port 50 to flow into the pressure chamber 55*a*. Then, due to a pressures to be generated in rear side of a flange portion at the rear end portion of the spool 52, the spool 52 is shifted against the biasing force of the spring 53 to release the cone seat 54 from the sealing seat 51*a* of the sleeve 51 for relieving the pressurized fluid to the tank passage 21. As can be appreciated from the discussion given hereabove, the third and fourth cartridge valves 28 and 29 operate as pressure relief valves for relieving pressure when the pressure in the first and second actuator passages 24 and 25 is grown to be higher than or equal to a set pressure.

The first load check valve 30 includes a sleeve 63 which is engaged with a mounting bore 61 via a seal member 62, such as an O-ring. A valve member 64 is disposed in the sleeve. The valve member 64 is constantly biased toward a valve seat 20*a* of the valve body 20 by means of a spring 65. A valve stem 66 formed integrally with the valve member 64 carries a suction valve body 67 fitted thereto. The suction the valve body 20 by the spring force of the spring 65 exerted on the valve member 64. While the suction valve body 67 is seated on the valve seat 20*b* of the valve body 20, the fluid communication between the outlet side 22*b* of the first pump passage 22 and the tank passage 21 is blocked. On the other hand, when the pressure in the first pump passage 22 becomes negative, the suction valve body 67 is depressed by the pressure in the tank passage 21 to shift away from the valve seat 20*b* against the force exerted by the spring 65. With the construction set forth above, the first suction valve 31 is formed.

It should be noted that the second load check valve 32 and the second suction valve 33 have the same constructions to those of the first load check valve 30 and the first suction valve 31.

On the first end surface 20*c* of the valve body 20, a first cover 70 is mounted for covering the first and third cartridge valves 26 and 28. A first electromagnetic proportioning control valve 71 is provided in order to supply the pressurized fluid to respective pressure chambers 46 and 55 of the first and fourth cartridge valves 26 and 29.

Similarly, on the second end surface 20*d* of the valve body 20, a second cover 72 is mounted for covering the second and fourth cartridge valves 27 and 29. A second electromagnetic proportioning control valve 73 is mounted on the second cover 72 for supplying the pressurized fluid to the second and third cartridge valves 27 and 28.

The first electromagnetic proportioning control valve 71 includes a sleeve 75 defining a port 74. A spool 78 is slidably disposed within the sleeve 75. The spool 78 is normally biased toward the closing position where the port 74 is blocked from a sleeve outlet 78. The spool 78 is held in contact with a plunger of a proportioning solenoid 79 so that the spool 78 may be driven to the opening position where the fluid communication between the port 74 and the sleeve outlet 78 is established when the proportioning solenoid 79 is energized by an electric control signal. The sleeve 75 is engaged within a mounting bore 80 in such a manner that the port 74 is held in communication with an inlet 84 and the sleeve outlet 78 is in communication with a fluid bore 82 which is, in turn, in communication with the pressure chambers 48 and 55 of the first and fourth cartridge valves 28 and 29. Therefore, the first electromagnetic proportioning control valve 71 discharges the pressurized fluid in an amount proportional to the magnitude of the electric control signal applied to the solenoid 79 into the fluid bore 82.

The construction of the second electromagnetic proportioning control valve 73 is essentially the same as that of the first electromagnetic proportioning control valve 71. It should be noted that the fluid bore 82 associated with the second electromagnetic proportioning control valve 73 is communicated with the pressure chambers 46 and 55 of the second and third cartridge valves 27 and 28.

The operation of the preferred embodiment of the hydraulic valve assembly constructed as set forth above will be discussed in terms of application for driving a hydraulic cylinder 83, as illustrated in FIG. 2. As can be seen, the hydraulic cylinder 83 defines first and second fluid chambers 83*a* and 83*b* at both sides of a piston 83*c*. The hydraulic cylinder has a first port 83*d* communicated with the first fluid chamber 83*a* and a second port 83*e* communicated with the second fluid chamber 63*b*. The first port 83*d* is connected to the outlet side 24*b* of the first actuator passage 24 and the second port 53*e* is connected to the outlet side 25*b*of the second actuator passage 25. On the other hand, the tank passage 21 is communicated with a reservoir tank 84. Also, the inlet sides 22*a* and 23*a* of the first and second pump passages 22 and 23 are connected to a pump 85. On the other hand, inlets 81 of the first and second electromagnetic proportioning control valves 71 and 73 are connected to a pilot pump 87.

Here, when the control signal is supplied to the first electromagnetic proportioning control valve 71 for energization thereof, the port 74 of the first electromagnetic proportioning control valve is communicated with the sleeve outlet 78 in the extent proportional to the magnitude of the control signal. Therefore, the pressurized fluid supplied to the inlet 81 of the sleeve 75 from the pilot pump 87 is discharged from the sleeve outlet 78. The pressurized fluid thus discharged is introduced into the pressure chambers 46 and 55 of the first and fourth cartridge valves 26 and 29. Therefore, the pressure in the pressure chambers 46 and 55 of the first and fourth cartridge valves 26 and 29 are increased to overcome the force of the springs 45 and 53 to shift the spools 43 and 52 to the open positions away from respective sealing seats. As a result, a hydraulic circuit including the pump 85, the first pump passage 22, the first actuator passage 24, the first chamber 83*a* of the actuator 83, the second actuator passage 25, the tank passage 21 and the tank 84 is established to introduce the pressurized fluid into the first fluid chamber 83*a* of the hydraulic cylinder 83 to drive the piston 83*c* to the right as seen in FIG. 2.

Similarly, when the control signal is supplied to the second electromagnetic proportioning control valve 73, the pressurized fluid from the pilot pump 87 is discharged from the sleeve outlet 78 to the pressure chambers 46 and 55 of the second and third cartridge valves 27 and 28 to shift the spools 43 and 52 to the open position. Therefore, a hydraulic circuit including the pump 85, the second pump passage 23, the second actuator passage 25, the second fluid chamber 83*b* of the actuator 83, the first actuator passage 24, the tank passage 24 and the tank 84, is established for driving the piston 83*c* of the hydraulic cylinder toward left, as seen in FIG. 2.

In the shown construction, since the communication between the tank passage 21 and the first and second actuator passages 24 and 25 is established and blocked by means of the cone seat type third and fourth cartridge valves 28 and 29, sufficient seal width can be attained irrespective of the stroke of the spool and/or the interval between the ports. Therefore, leakage of the fluid from the first and second actuator passages 24 and 25 to the tank passage 24 can be certainly avoided.

Also, in the illustrated construction, the first, second, third and fourth cartridge valves 26, 27, 28 and 29 are formed as sub-assemblies which can be preliminarily assembled before installation within the valve body 20. Therefore, for the valve body 20, it is only required to form the mounting bores for receiving these cartridge valves in the sub-assembly form. This avoids necessity of formation of the spool bores and ports with high precision to make machining of the valve body easier and inexpensive.

In addition, such first, second, third and fourth cartridge valves 26, 27, 28 and 29 as the sub-assemblies can accommodate a certain amount of deformation or distortion of the valve body with respect to the clearances between the sleeve and the mounting bores and still maintain a smooth sliding movement of the spools. Therefore, the hydraulic valve assembly according to the present invention permits installation of additional valve assembly to a stack-type valve assembly, in which a plurality of valve assemblies are stacked and fixed by means of the stack bolts.

Although the invention has been illustrated and described with respect to exemplary embodiment thereof, it should be understood by those skilled in the art from the foregoing that various other changes, omissions and additions may be made therein and thereto, without departing from the spirit and scope of the present invention. Therefore, the present invention should not be understood as limited to the specific embodiment set out above but to include all possible embodiments which can be included within a scope encompassed, and equivalents thereof, with respect to the feature set out in the appended claims.

What is claimed is:

1. A hydraulic valve assembly comprising:

a valve body defining first and second valve receptacle bores;

a fluid pump;

first fluid passage means communicated with said fluid pump for receiving a pressurized working fluid therefrom;

second fluid passage means communicated with a hydraulic load;

third fluid passage means communicated with a fluid reservoir for recirculating working fluid thereto;

a first valve sub-assembly including a sleeve enclosing a first valve mechanism therein and disposed within said first valve receptacle bore for selectively permitting and blocking introduction of the pressurized working fluid through said first fluid passage;

a second valve sub-assembly including a sleeve enclosing a second valve mechanism therein and disposed within said second valve receptacle bore for selectively establishing and blocking fluid communication between said second and third fluid passage means, said second valve mechanism comprising a spool which is reciprocatively disposed in a first axial bore formed in said sleeve, said first axial bore having a first end which opens into said third passage means and defines a port in fluid communication with said third passage means, said spool having an end which is formed with an outwardly extending conical portion which seats on an inwardly tapered portion formed in a mouth of said port, when said spool moves in said first axial bore away from said third passage means and toward a second end of first said axial bore distal from said third passage means;

pressure relieving means, comprising spool valve means disposed in a second axial bore formed in said spool of said second valve mechanism, for relieving pressure in said second fluid passage means which is above a predetermined set pressure;

a third valve assembly for selectively establishing and blocking fluid communication between a load side of said first valve sub-assembly and said second fluid passage means for supplying the pressurized working fluid to said hydraulic load; and a valve control means including a source of pilot pressure and a solenoid controlled valve, for generating a control pressure which moves said first and second valve sub-assemblies between a supply mode position wherein the pressurized fluid from said fluid pump is supplied to said hydraulic load through said first valve sub-assembly and said third valve assembly, and a drain mode position wherein working fluid is drained from said hydraulic load through said second valve sub-assembly and said third fluid passage means.

* * * * *